United States Patent [19]

Kikuta

[11] Patent Number: 4,802,860

[45] Date of Patent: Feb. 7, 1989

[54] SURFACE MOUNT TYPE ELECTRICAL CONNECTOR

[75] Inventor: Shigeru Kikuta, Tokyo, Japan

[73] Assignee: Hirose Electric Co., Ltd., Tokyo, Japan

[21] Appl. No.: 162,577

[22] Filed: Mar. 1, 1988

[30] Foreign Application Priority Data

Mar. 4, 1987 [JP] Japan ..... 62-31588[U]
Mar. 4, 1987 [JP] Japan ..... 62-31589[U]

[51] Int. Cl.[4] ..... H01R 9/09

[52] U.S. Cl. ..... 439/79; 439/82; 439/83

[58] Field of Search ..... 439/79–83, 439/547, 553

[56] References Cited

U.S. PATENT DOCUMENTS 4,583,807 4/1986 Kaufman et al. ..... 437/83
4,628,410 12/1986 Goodman et al. ..... 361/413
4,660,911 4/1987 Reynolds et al. ..... 439/83
4,709,973 12/1987 Waters et al. ..... 439/82
4,717,219 1/1988 Frantz et al. ..... 439/82
4,756,696 7/1988 Whiteman ..... 439/79

*Primary Examiner*—Paula A. Austin Bradley
*Attorney, Agent, or Firm*—Takeuchi Patent Office

[57] ABSTRACT

A surface mount type electrical connector comprising an insulating housing having a plurality of contact receiving apertures and a plurality of contacts, each having a front contacting section, an intermediate section, and a rear section. The rear section is movably placed in a channel of the insulating housing so as to not only protect from foreign objects making short circuit or deformation but also absorb all the applied stresses uniformly. The insulating housing is mounted with a pair of mounting members to prevent warping or separation from the printed circuit board.

9 Claims, 5 Drawing Sheets

SURFACE MOUNT TYPE ELECTRICAL CONNECTOR

BACKGROUND OF THE INVENTION

The present invention relates to surface mount type electrical connectors to be mounted on a printed circuit board (PCB) in such a manner that the contacting sections of contactors in an insulating housing may be superposed on the conductors of the PCB for making connection.

Recently, various types of compact electronic equipment have been assembled by machines. As a result, there has been a need for high density and automatic mounting of various electronic components on a PCB. In response to such a need, Japanese Patent Kokai No. 60-140688 has proposed a surface mount type electrical connector. This surface mount type electrical connector is mounted on a PCB in such a manner that the legs (connecting sections) of contacts may be soldered to the electrical circuits (conductive pads).

FIG. 10 shows such a conventional surface mount type electrical connector 3 which is mounted on a PCB 2, with the legs 8 of its contacts 5A–5C soldered on conductive pads 2A by reflow soldering technique. By the reflow soldering technique, after the conductive pads 2A have been formed or cream solder has been applied to the circuit, the legs 8 are soldered by heating either the entire PCB-connector assembly in a furnace or only the legs with laser or infrared rays to melt the solder for making connection. Because of a difference in thermal expansion coefficient between the connector housing and the PCB, there are produced stresses between the legs and the pads after cooling. These stresses are absorbed by spring arms 7 to certain degrees. The housing 4 also has a pair of depending studs 9.

However, the above conventional surface mount type electrical connector has the following disadvantages.

(1) The tail portions 6 of contacts extending from an end of the housing 4 are not protected so that they can cause short-circuit or deformation when a foreign object contacts or strikes them. In addition, the tail portion 6 can be easily bent during soldering so that the leg is offset from the conductive pad, making soldering connection impossible.

(2) When several contacts are arranged in one layer upon another in the housing, the length of the top contact arm 7 is longer than those of lower contact arms 7. Consequently, the degrees to which they can absorb the stresses produced upon soldering are different. More specifically, if the bottom contact arm 7 is shortened for compactness, it would not fully absorb the stress, whereas if it is lengthened to assure absorption of the stress, the connector becomes larger, preventing its high density mounting on a PCB.

(3) The depending studs 9 of the housing 4 are inserted into mounting apertures of a PCB but not firmly secured to the PCB. Consequently, as the connector-PCB assembly is transported for soldering, the connector can be separated from the PCB due to vibrations or impacts. Even after soldering, the soldered portions can be separated by external forces. In addition, the housing can bend backward and come off from the PCB because of their different thermal expansion coefficients upon cooling, making the soldered portions separate.

SUMMARY OF THE INVENTION

Accordingly, it is an object of the invention to provide a surface mount type electrical connector which is compact, easy to position, and able to absorb uniformly all the stresses applied to contacts of a multilayer structure.

According to the invention there is provided a surface mount type electrical connector comprising an insulating housing having a plurality of contact receiving apertures; a plurality of contacts each mounted in each of the contact receiving apertures; the contact having a contacting section for contact with a mating connector contact, a terminal portion to be connected to a conductor of a printed circuit board, and an intermediate section beween them having a pair of broadened engaging members; the contact receiving aperture having a pair of grooves for receiving said broadened engaging members to retain the contact therein; and a plurality of receiving channels each communicating with the receiving aperture for receiving a rear section of the contact behind the broadened engaging members in such a manner that the rear section may be slidably movable in the grooves, thus absorbing the stresses applied to said rear section during soldering.

According to another aspect of the invention there is provided a suface mount type electrical connector further comprising a pair of mounting sections provided on opposite sides of the insulating housing, each having a mounting aperture for receiving a mounting member; and a circular rim provided on a bottom of the mounting section around the mounting aperture for insertion into an aperture of the printed circuit board for providing accurate positioning.

Other objects, features, and advantages of the invention will be apparent from the following description when taken in conjunction with the accompanying drawings.

DESCRIPTION OF THE PREFERRED EMBODIMENTS

Figure 1:
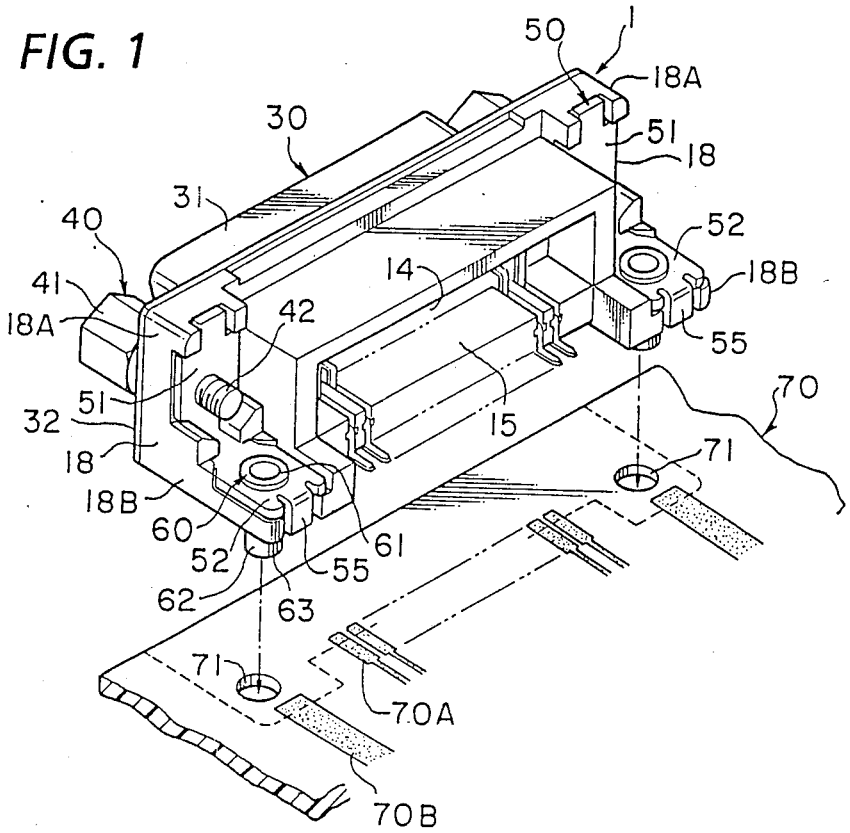
FIG. 1 is a perspective view of a surface mount type electrical connector according to an embodiment of the invention.
Figure 2:
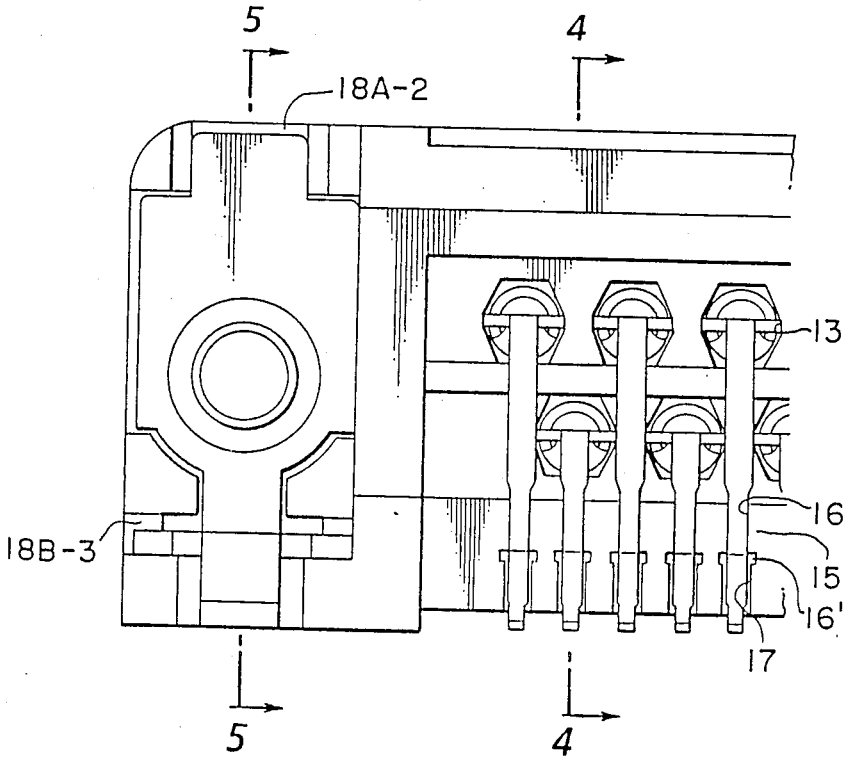
FIG. 2 is a rear view of essential part of the electrical connector of FIG. 1.

In FIGS. 1–5, a surface mount type electrical connector 1 according to an embodiment of the invention includes an insulating housing 10, a plurality of female contacts 20, and a shield case 30. The insulating housing 10 is integrally formed from an insulating material so as to have a plurality of contact receiving apertures 11 with a tapered opening 12 on the front or mating end. Preferably, the contact receiving aperture 11 has a hexagonal cross section as best shown in FIG. 2. A pair of grooves 13 are provided in the rear portion of the receiving aperture 11 to receive a first broadened engaging member 24 provided on an intermediate section 22 of the female contact 20. A rectangular hollow area 14 is provided above a bottom wall 15 in the rear portion of the housing 10. A plurality of horizontal channels 16 and vertical channels 17 are provided on the bottom wall 15 to receive rear sections 23 of the female contacts 20. A pair of second grooves 16' are provided along the bottom of the horizontal channel 16 to receive a second broadened engaging member 29 provided in the rear section of the female contact 20. A pair of generally L-shaped mounting sections 18 are provided on opposite sides of the insulating housing 10.

Figure 5:
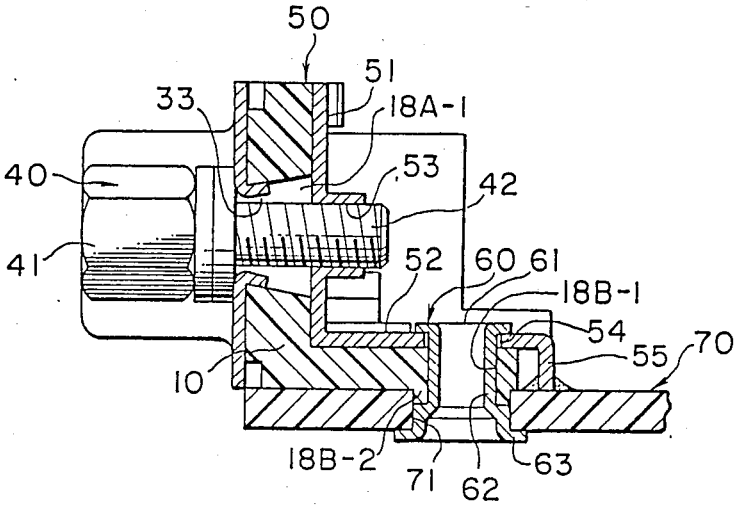
FIG. 5 is a sectional view taken along the line 5—5 of FIG. 2.

As best shown in FIG. 5, an aperture 18A-1 is provided through a vertical wall 18A of the L-shaped mount 18 to receive a threaded portion 42 of a locking member 40 whereas an aperture 18B-1 is provided through a horizontal wall 18B to receive a mounting member 60. A circular rim 18B-2 is provided at the bottom of the aperture 18B-1 to facilitate positioning the electrical connector on the PCB 70. As shown in FIGS. 1–2, a upper recess 18A-2 and a receiving groove 18B-3 are provided on the upper backside of the vertical wall 18A and on the top of the horizontal wall 18B, respectively, to receive an L-shaped metal member 50 which will be described later in more detail.

Figure 3:
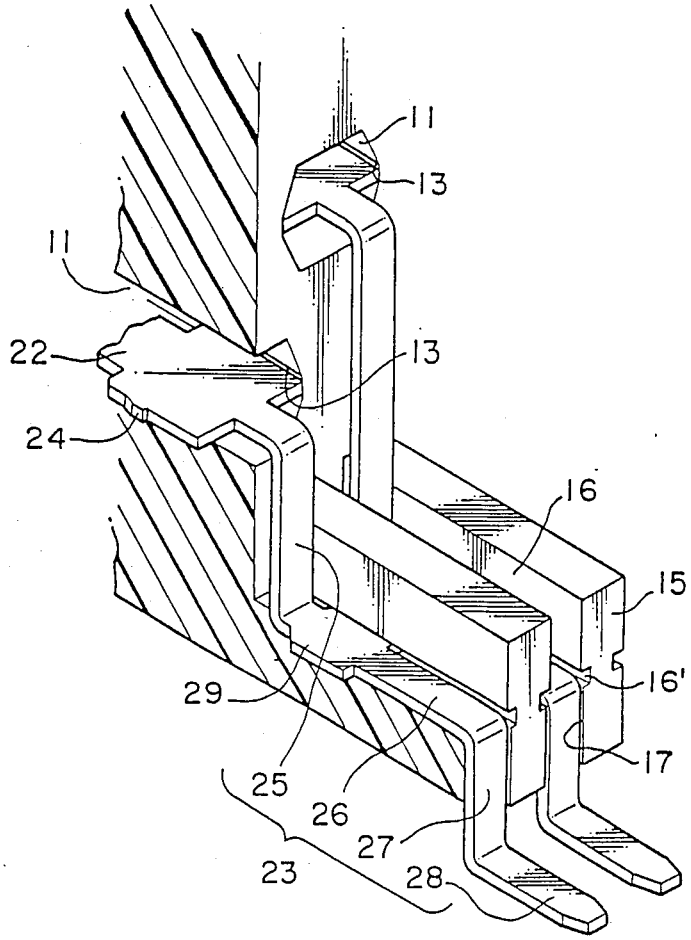
FIG. 3 is a perspective view of contacts useful for the electrical connector of FIG. 1.
Figure 4:
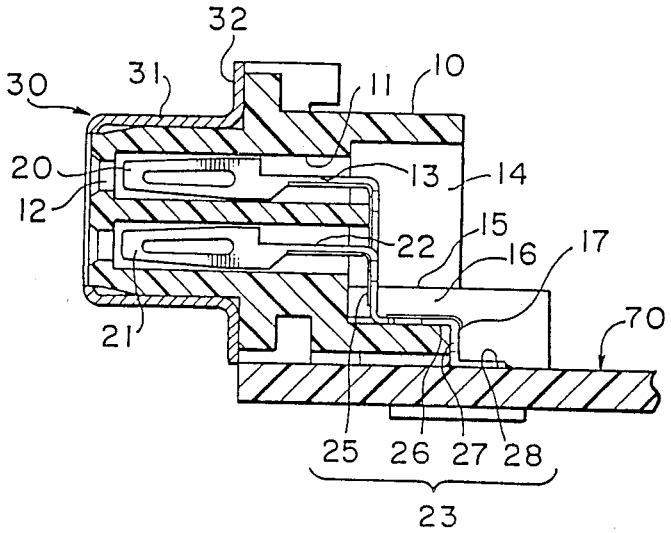
FIG. 4 is a sectional view taken along the line 4—4 of FIG. 2.

The female contacts 20 are stamped and formed from a metal sheet. As shown in FIGS. 3–4, the female contact 20 has a front spring contacting section 21 for receiving the contacting section of a mating male contact, an intermediate section 22, and a rear section 23. The intermediate section 22 connects the contacting section 21 and the rear section 23 and has a pair of first engaging members 24 for engaging with the grooves 13 of a receiving aperture 11 to firmly retain the female conact within the insulating housing 10. The rear section 23 has a first vertical portion 25, a horizontal portion 26, a second vertical portion 27, and a horizontal terminal portion 28. The horizontal portion 26 has a pair of second engaging members 29 for engaging the grooves 16' of a channel 16 to firmly retain the rear section 23 within the horizontal channel 16. It should be noted that the widths of the horizontal portion 26 and the second vertical portion 27 behind the second engaging member 29 are made less than those of the horizontal channel 16 and the vertical channel 17 so that the horizontal portion 26 and the second vertical portion 27 may be slidably movable in both horizontal and vertical directions. The reason for providing such a slight play will be described later. The terminal portion 28 extends rearwardly so as to abut a signal circuit or conductive pad 70A of the PCB 70 for soldering. In this illustrated embodiment, a number of female contacts 20 are mounted alterntingly in two layers so that every other contacts are placed on the same layer. As a result, the lengths of the first vertical portions 25 are different between the adjacent contacts, but the structures behind the second engaging members 29 are identical.

The shield case 30 is made of metal so as to have a front enclosure 31 for enclosing the insulating housing 10 and a rear flange 32 for abutting the vertical walls 18A. As best shown in FIG. 5, an aperture 33 is provided on each side of the flange 32 to receive the threaded portion 42 of a locking member 40. The locking member 40 is made of metal so as to have a hexagonal head 41 and a male thread 42. Although it is not shown, the hexagonal head 41 has a female thread portion for receiving a male thread portion of a mating lock member. The threaded portion 42 is threaded into the female thread portion 52 of the L-shaped metal member 50 to secure the shield case 30 to the insulating housing 10.

The L-shaped member 50 is made of metal so as to have a vertical section 51 and a horizontal section 52. The vertical section 51 has a threaded aperture 53 for receiving the threaded portion 42 of a locking member 40. The horizontal section 52 has an aperture 54 for receiving a mounting member 60 which will be described later. Extending downwardly from the end of the horizontal section 52 is a vertical terminal portion 55 to be soldered to the ground circuit 70B of the PCB 70.

The mounting member 60 is made of metal in a generally cylindrical form to have a top flange 61 and a cylindrical body 62. The bottom edge 63 of the cylindrical body 62 is deformed to join the connector and the PCB together.

The electrical connector 1 according to the invention may be mounted on the PCB 70 as follows.

(1) As FIG. 1 shows, the electrical connector 1 is disposed above the PCB 70 and the cylindrical body 62 of the mounting members 62 are inserted into the apertures 71 of the PCB 70. By positioning action of the cylindrical body 62 and the mounting aperture 71, the terminal portion 28 of each contact 20 and the ground terminal 55 of each L-shaped member 50 are superposed on the corresponding signal circuit or conductive pad 70A and the corresponding ground circuit 70B, respectively. As best shown in FIG. 5, the circular rim 18B-2 of the horizontal wall 18B is made concentric with the aperture 18B to assure accurate positioning. As a result, all the terminal portions are in registration with the corresponding conductive pads arranged at predetermined intervals. Preferably, the outside diameter of the circular rim 18B-2 is made substantially equal to the inside diameter of the mounting aperture 71 so that the circular rim 18B-2 may fit into the mounting aperture, assuring more accurate positioning.

(2) Then, the bottom edge 63 of the cylindrical body 62 is deformed with a proper tool to join the connector 1 and the PCB 70 together.

(3) When the connector-PCB assembly is heated in a furnace, the solder applied to the circuit of the PCB melts to electrically connect the terminal portions of the respective contacts 20 and the ground terminals 55 of the L-shaped members 50 with the conductive pads 70A and the ground terminals 55, respectively, by reflow soldering.

When the terminal portions 28 of contacts are soldered to the signal circuits 70A, the connector-PCB assembly is heated to melt the solder and then cooled to normal temperature. The thermal expansion coefficients of materials for the PCB 70, the insulating housing 10, and the contacts 20 are different so that the intervals of the receiving apertures 11 and the conductive pads 70A are made different, applying stresses to the rear sections 23 of the respective contacts 20 until the respective components are completely cooled. However, as described above, the horizontal portion 26 and the second vertical portion 27 behind the second engaging member 29 are slidably movable in the horizontal grooves 16 and the vertical grooves 17, respectively, thus absorbing the stresses applied to the rear section 23.

Figure 6:
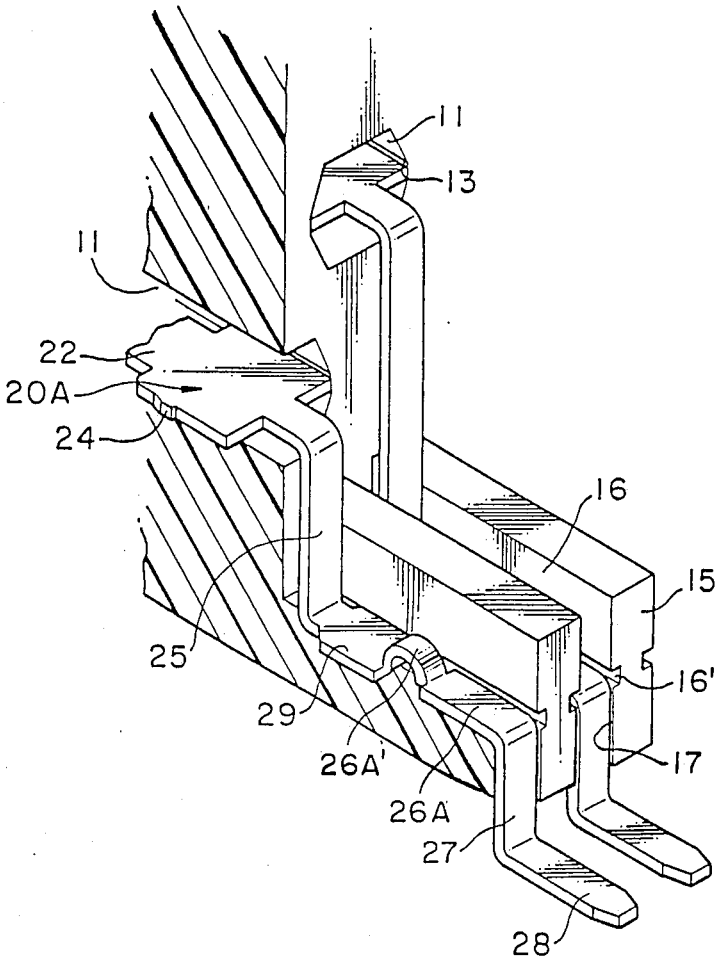
FIG. 6 is a perspective view of contacts according to another embodiment of the invention.

FIG. 6 shows contacts 20A according to another embodiment of the invention. This contact 20A is identical with the contact 20 except for the structure between the second engaging member 29 and the terminal portion 28. A curved portion 26A' is provided on the horizontal section 26A adjacent to the second engaging member 29 to facilitate the aforementioned play or horizontal sliding movement. This curved portion 26A' allows resilient horizonal and vertical movement of the horizonal portion 26A and the vertical portion 27 when the terminal portions 28 are soldered to the conductive circuits.

Figure 7:
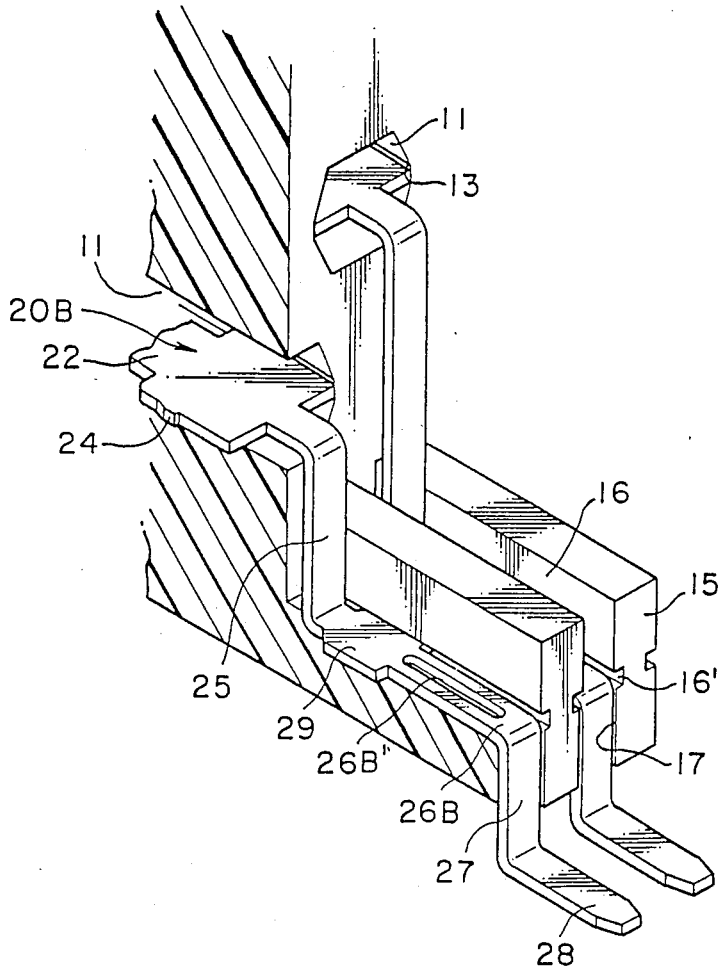
FIG. 7 is a perspective view of contacts according to still another embodiment of the invention.

FIG. 7 shows contacts 20B according to still another embodiment of the invention. This contact 20B is identical with the contact 20A except that a slit 26B' is provided on the horizontal portion 26B adjacent to the second engaging member 29 instead of the curved portion 26A' of the contact 20A. This slit 26B' allows resilient horizontal and vertical movement of the horizontal portion 26B and the second vertical portion 27.

Figure 8:
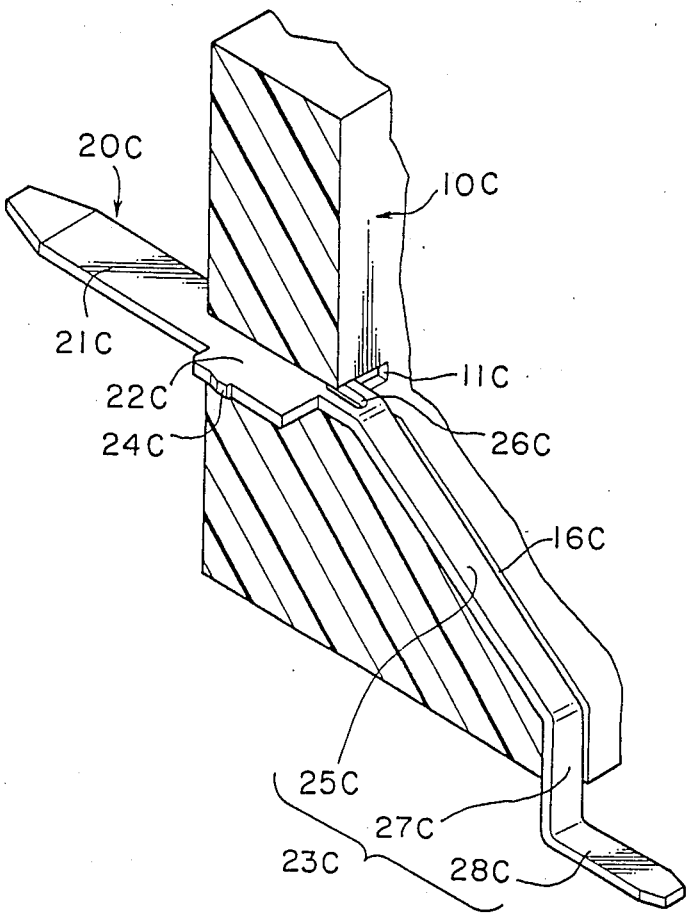
FIG. 8 is a perspective view of a contact according to yet another embodiment of the invention.
Figure 10:
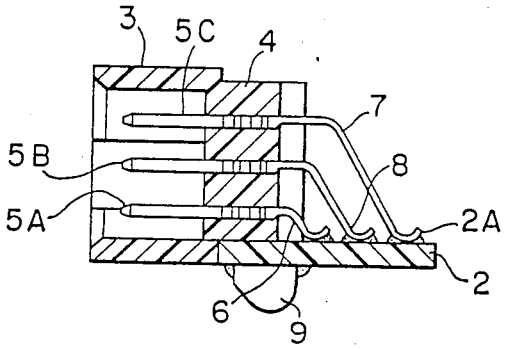
FIG. 10 is a sectional view of a conventional surface mount type electrical connector.

FIG. 8 shows a contact 20C according to yet another embodiment of the invention. Unlike the above contacts, this contact 20C has a male contacting section 21C. It also has an intermediate section 22C and a rear section 23C which consists of a sloping portion 25C, a vertical portion 27C, and a horizontal terminal portion 28C. A slit 26C is provided immediately behind the engaging member 24C. The insulating housing 10C has a contact receiving slot 11C and a sloping channel 16C communicating with the receiving slot. The contact 20C is firmly retained in the receiving slot 11C by the engaging members 24C, with the sloping portion 25C and the vertical portion 27C resiliently movable horizontally and vertically in the receiving channel 16C. The slit 26C increases this spring property. With this structure, a great number of contacts may be arranged in a single level.

Figure 9:
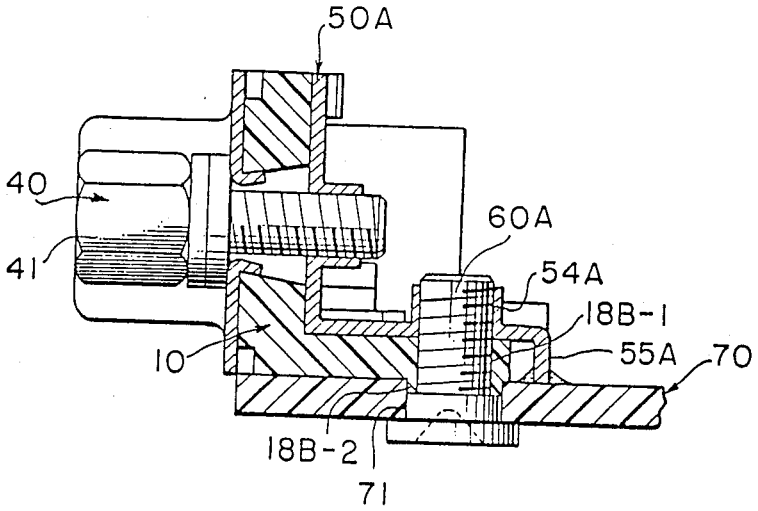
FIG. 9 is a sectional view taken along the line 5—5 of FIG. 2 according to another embodiment.

FIG. 9 shows a mounting section of the housing 10 according to another embodiment of the invention. In the embodiment of FIG. 5, the electrical connector is secured to the PCB 70 by deforming the bottom edge 63 of a cylindrical mounting member 60, whereas, in this embodiment, a threaded mounting member 60A is used and a female thread 54A is provided on the L-shaped member 50A. The connector is secured to the PCB 70 by inserting the circular rim 18B-2 of the insulating housing 10 into the mounting aperture 71 and then threading the mounting member 60A into the female thread 54A.

The surface mount type electrical connector of the invention has the following advantages.

(1) The rear section of a contact is protected in the channel of an insulating housing, thus eliminating the possibility of making a short-circuit through a contacting foreign object. The rear section is movable horizontally and vertically in the channel so that the reflow soldering stresses upon cooling may be released, thus eliminating the possibility of separation of the soldered portions or deformation of the contact.

(2) When contacts are arranged in many layers in an insulating housing, it is possible to make the lengths of the rear sections of respective contacts equal so that the contacts abosorb the applied stresses uniformly from top to bottom layer, thus eliminating the possibility of deformation of the contacts or separation of the soldered portions due to unbalanced absorption of the stresses. This arrangement makes the connector more compact to meet the requirement for high density mounting.

(3) The lower surface of a mounting section of the insulating housing has a circular rim concentric with the aperture of a PCB so that the connector is mounted on the PCB with a mounting member with high accuracy. The secure attachment to the PCB by the mounting member prevents the connector from bending backward or coming off from the PCB upon cooling of the reflow soldering.

While a preferred embodiment of the invention has been described using specific terms, such description is illustrative purposes only, and it is to be understood that changes and variations may be made without departing from the spirit and scope of the invention as recited in the appended claims.

What is claimed is:

1. A surface mount type electrical connector comprising:

an insulating housing having a plurality of contact receiving apertures;

a plurality of contacts each mounted in each of said contact receiving apertures;

said contact having a contacting section for contact with a mating connector contact, a terminal portion to be connected to a conductor of a printed circuit board, and an intermediate section between them having a pair of broadened engaging members;

said contact receiving aperture having a pair of grooves for receiving said broadened engaging members to retain said contact therein; and a plurality of receiving channels each communicating with said receiving aperture for receiving a rear section of said contact behind said broadened engaging members in such a manner that said rear section may be slidably movable in said grooves.

2. The surface mount type electrical connector of claim 1, wherein said contact has a curved portion adjacent to said engaging member to facilitate said slidable movement of said rear section.

3. The surface mount type electrical connector of claim 1, wherein said contact has a slit portion adjacent to said engaging member to facilitate said slidable movement of said rear section.

4. The surface mount type electrical connector of claim 1, wherein said contacts are arranged alternatingly in two layers so that every other contacts may be placed on the same layer, with all of said rear sections being equal in length.

5. The surface mount type electrical connector of claim 1, wherein said contacts are arranged in a single level, with all of said rear sections being equal in length.

6. The surface mount type electrical connector of claim 5, wherein said contact has a sloping section between said engaging member and said terminal portion.

7. A surface mount type electrical connector comprising:

an insulating housing having a plurality of contact receiving apertures;

a plurality of contacts each mounted in each of said contact receiving apertures;

said contact having a contacting section for contact with a mating connector contact, a terminal portion to be connected to a conductor of a printed circuit board, and an intermediate section between them having a pair of broadened engaging members;

said contact receiving aperture having a pair of grooves for receiving said broadened engaging members to retain said contact therein;

a plurality of receiving channels each communicating with said receiving aperture for receiving a rear section of said contact behind said broadened engaging members in such a manner that said rear section may be slidably movable in said grooves;

a pair of mounting sections provided on opposite sides of said insulating housing, each having a mounting aperture for receiving a mounting member; and a circular rim provided on a bottom of said mounting section around said mounting aperture for insertion into an aperture of said printed circuit board for providing accurate positioning.

8. The surface mount type electrical connector of claim 7, wherein said mounting member has a deformable bottom edge.

9. The surface mount type electrical connector of claim 7, wherein said mounting member has a threaded portion at an end.

* * * * *